United States Patent [19]

Gwinn, Jr.

[11] Patent Number: 4,689,907

[45] Date of Patent: Sep. 1, 1987

[54] SMALL ARM MAGAZINE

[76] Inventor: Mack W. Gwinn, Jr., P.O. Box 61, Stetson Rd., Levant, Me. 04456

[21] Appl. No.: 863,003

[22] Filed: May 14, 1986

[51] Int. Cl.[4] ..... F41C 25/10

[52] U.S. Cl. ..... 42/50; 89/33.02

[58] Field of Search ..... 42/50; 89/33.02

[56] References Cited

U.S. PATENT DOCUMENTS

| | | | |
|---|---|---|---|
| 1,042,837 | 10/1912 | Tatarek | 42/50 |
| 1,368,375 | 2/1921 | Turner | 42/50 |
| 1,921,871 | 8/1933 | Gaidos | 42/50 |
| 2,223,380 | 12/1940 | Michal, Jr. | 89/33.02 |
| 2,311,497 | 2/1943 | Van Horn et al. | 42/50 |
| 4,332,097 | 6/1982 | Taylor, Jr. | 42/50 |

FOREIGN PATENT DOCUMENTS

| | | | |
|---|---|---|---|
| 305074 | 2/1922 | Fed. Rep. of Germany | 42/50 |
| 571770 | 3/1933 | Fed. Rep. of Germany | 89/33.02 |
| 1928 | of 1911 | United Kingdom | 42/50 |

*Primary Examiner*—Charles T. Jordan

*Attorney, Agent, or Firm*—Michael W. York

[57] ABSTRACT

A small arm magazine for small arms having a magazine well including a generally drum shaped housing portion and a projecting cartridge feed chute portion that projects outwardly from the drum shaped housing portion substantially tangentially to its outer circumferential portion. The interior of the generally drum shaped housing portion is shaped to guide cartridges in generally a curved spiral path. A large portion of the drum shaped housing portion is located to one side of the cartridge feed chute portion and a gap exists between the cartridge feed chute and the adjacent portion of the generally drum shaped housing portion to permit the cartridge feed chute portion to be readily inserted into the magazine well of the small arm. This configuration of the magazine permits the magazine to have a large capacity without having portions of the magazine project downward below the small arm and interfere with the use of the small arm when the magazine is located in place with its feed chute portion in the small arm.

17 Claims, 6 Drawing Figures

SMALL ARM MAGAZINE

BACKGROUND OF THE INVENTION

Modern military type rifles and similar small arms usually can be fired on full automatic or in controlled bursts of fire and as a consequence they need to be loaded with an adequate supply of cartridges. This is usually accomplished by designing the receiver of the firearm to accept a box type magazine. This opening is commonly referred to as a magazine well and usually involves some type of protrusion or the like that fits around and secures a portion of the magazine in its proper position so that proper feeding of the cartridges into the chamber of the firearm is accomplished.

These magazines commonly extend downward from the lower portion of the receiver. In view of the construction of the magazines and their location within the small arm the amount of ammunition that can be loaded in a given magazine is definitely limited. The amount of ammunition that can be loaded into such magazines can be increased by increasing the length of the magazine and by providing means for staggering the ammunition within the magazine so that there are two staggered columns of ammunition which are fed into the receiver of the firearm through the magazine well. However, since such small arms must be used with the firer in the prone position the capacity of such magazines is limited due to the limitation on its length.

Since modern day military small arms have a high rate of fire when fired on full automatic this has meant that empty magazines have had to be ejected from the magazine well and replaced by loaded magazines at frequent intervals. This, of course, is very detrimental under combat conditions and under certain situations such as night fighting or when firing from inside vehicles it may be particularly difficult. Indeed, it may even be difficult with the firer in the prone position. Consequently, the need exists to further increase the capacity of the magazine so that it does not need to be replaced as often as it is under current circumstances.

One solution that has been attempted in the past is to provide the weapon or firearm with a drum type of magazine. This type of magazine has the capability of carrying a large number of cartridges. Although the drum type of magazine offers the advantage of having additional ammunition capacity there are also several important disadvantages associated with prior art drum magazines. One disadvantage has been that they are rather complex and expensive to manufacture. Another disadvantage is that due to their complexity they have a tendency to jam. Moreover, under most circumstances in order to utilize a drum magazine a firearm or weapon had to be designed to accept such a magazine. In this connection, drum type magazines have generally not been designed to be utilized in rifles and the like which employ rather deep magazine wells for receiving the straight or curved double staggered type ammunition magazines.

Drum types of magazines are by no means new and examples of such types of magazines are presented in U.S. Pat. Nos. 979,721; 1,042,837; 1,368,375; 1,921,871; 2,223,380; 2,321,720; and 2,367,572. It will be noted that these magazines are designed to feed cartridges into a receiver that either does not have a magazine well or into the magazine well of a pistol or the like which employs a single column type of feeding system. Other patents demonstrating drum magazines are U.S. Pat. Nos. 2,596,293 and 2,756,637. Additional similar foreign patents are German Pat. No. 571,770 and 2,326,542 plus British Pat. No. 539,414 and Italian Pat. No. 484,197.

Although some of these patents disclose provisions for feeding cartridges into a magazine well or the like they do not disclose adequate provisions for feeding cartridges from a drum magazine into the magazine well for a double staggered box type of magazine or the like. Moreover, many of these magazines employ follower systems or the like that are unduly complex. It should be noted that trying to cause a double staggered columns of cartridges to bend or curve creates the distinct possibility of jamming due to the increased resistance or friction between the outer portions of the cartridges and the means for causing the cartridges to bend or curve.

One inherent difficulty with the prior art magazines has been the tendency for the magazine follower and an associated cartridge or cartridges to tip forward in the magazine as an attempt is made to strip a cartridge from the magazine as the firearm bolt or the like moves forward. This almost always results in a jam that prevents the cartridge from being porperly fed into the chamber of the firearm. This tendency is more pronounced with followers for double staggered magazines.

These problems have been overcome with the present small arm magazine which includes a drum magazine which is readily usable in existing small arm weapons with magazine wells which have been designed with a regular box or clip type of magazine without any required modifications to the small arm. Moreover, the magazine is designed to be utilized in small arm weapons with magazine wells for the double column staggered type of magazines. In addition, the magazine is resistant to jamming caused by binding of two columns of staggered cartridges and its follower is also jam resistant. The magazine also does not interfere with the use of the small arm since its downward protrusion is limited.

SUMMARY OF THE INVENTION

This invention relates to small arm magazines and more particularly to large capacity small arm magazines.

Accordingly, it is a primary object of the invention to provide a small arm magazine that is particularly useful with small arms which are capable of expending a large amount of ammunition in a short period of time due to full automatic or burst fire.

It is another object of the invention to provide a small arm magazine that is particularly useful with small arms that have a high rate of fully automatic or burst fire.

It is also an object of the invention to provide a large capacity small arm magazine that is capable of being utilized in a small arm which is primarily designed to use a smaller capacity elongated box or clip type magazine.

It is another object of the invention to provide a large capacity small arm magazine that is capable of being utilized with a small arm which has a magazine well or projection in the receiver of the small arm that is designed to receive a smaller capacity elongated box or clip type magazine.

It is another object of the invention to provide a small arm magazine that reduces the need for the frequent replacement of the magazine when the small arm is being fired.

It is another object of the invention to provide a small arm magazine which is particularly useful with a small arm that is to be used under adverse conditions such as in a confined space such as that within a vehicle or under conditions of darkness.

It is another object of the invention to provide a small arm magazine that does not unduly project from the lower portion of the receiver of the small arm.

It is another object of the invention to provide a small arm magazine that holds a large amount of ammunition in a compact manner.

It is also an object of the invention to provide a small arm magazine that does not interfere with the use of the small arm with the firer in the prone position.

It is also an object of the invention to provide a small arm magazine that does not interfere with changing of the magazines particularly with the firer in the prone position.

It is a further object of the invention to provide a small arm magazine that reliably feeds ammunition into the small arm.

It is another object of the invention to provide a small arm magazine that allows cartridges to be fed in a double column staggered manner in a curved path without the tendency to jam.

It is also an object of the invention to provide a small arm magazine which permits reliable feeding of a curved double column of cartridges due to a unique application of the force from the magazine spring.

It is another object of the invention to provide a small arm magazine that reduces jamming caused by tipping of the magazine follower.

It is also an object of the invention to provide a small arm magazine of the drum type with a follower whose orientation is positively controlled.

It is another object of the invention to provide a small arm magazine that is easy to load with cartridges.

It is also an object of the invention to provide a small arm magazine with increased reliability due to its simple construction with few components.

It is a further object of the invention to provide a small arm magazine that can be readily loaded with common stripper clips or the like or by hand with individual cartridges.

It is also a further object of the invention to provide a small arm magazine which is interchangable with a plurality of small arms.

It is also an object of the invention to provide a firearm magazine which can give an indication of the approximate amount of cartridges remaining in the magazine even when it is difficult or impossible to see the magazine.

The invention provides a small arm magazine having a generally drum shaped housing portion, cartridge guiding means located within the drum shaped housing portion for guiding two columns of cartridges in at least a partially curved manner, and projecting cartridge feeding means projecting outwardly from the generally drum shaped housing portion for fitting into and feeding cartridges into the magazine well of a small arm which is sized and shaped to receive a magazine for staggered cartridges. The projecting cartridge feeding means projects tangentially from the outer portion of the generally drum shaped housing portion.

BRIEF DESCRIPTION OF THE DRAWINGS

The invention will be hereinafter described in detail with reference to the accompanying drawings in which.

DETAILED DESCRIPTION OF THE PREFERRED EMBODIMENT

Figure 1:
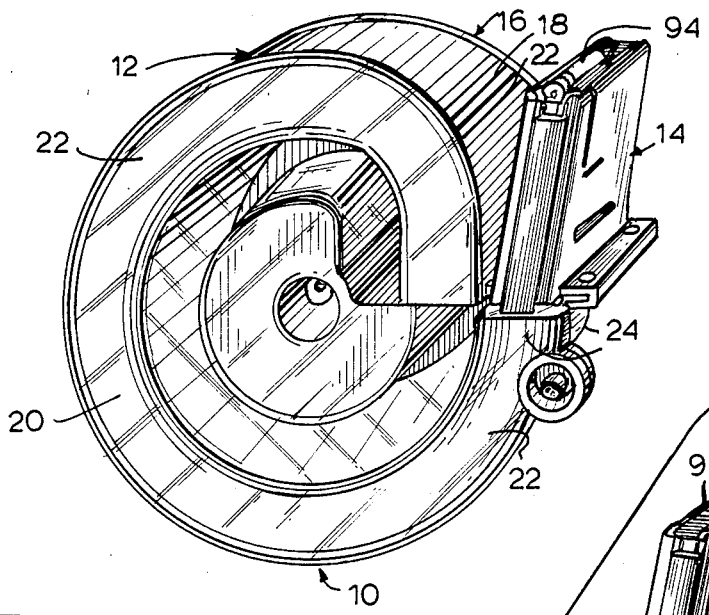
FIG. 1 is a rear perspective view of the small arm magazine of the present invention.

Referring first to FIG. 1, the small arm magazine of the invention is illustrated and is designated generally by the number 10. The small arm magazine 10 comprises a generally drum shaped housing portion 12 and a projecting cartridge feed chute portion 14 that projects outwardly from the drum shaped housing portion 12 substantially tangentially to the outer circumferential portion of the drum shaped housing portion 12. The drum shaped housing portion 12 comprises a substantially drum shaped magazine drum 16 whose outer surface 18 tapers inwardly from its rear to its forward portion and a drum cover 20 that is connected to and covers the open aft or rear portion of the magazine drum 16.

The drum cover 20 is made from a suitable plastic material so that it is transparent or semitransparent in order that rear portions of cartridges in the drum shaped housing portion can be viewed to determine the approimate amount of rounds or cartridges remaining in the small arm magazine 10. Both the magazine drum 16 and its connected drum cover 20 are shaped in order that the drum shaped housing portion 12 has an outward spiraling cartridge guiding portion 22 whose outer end portion 24 is joined to the projecting cartridge feed chute portion 14.

Figure 2:
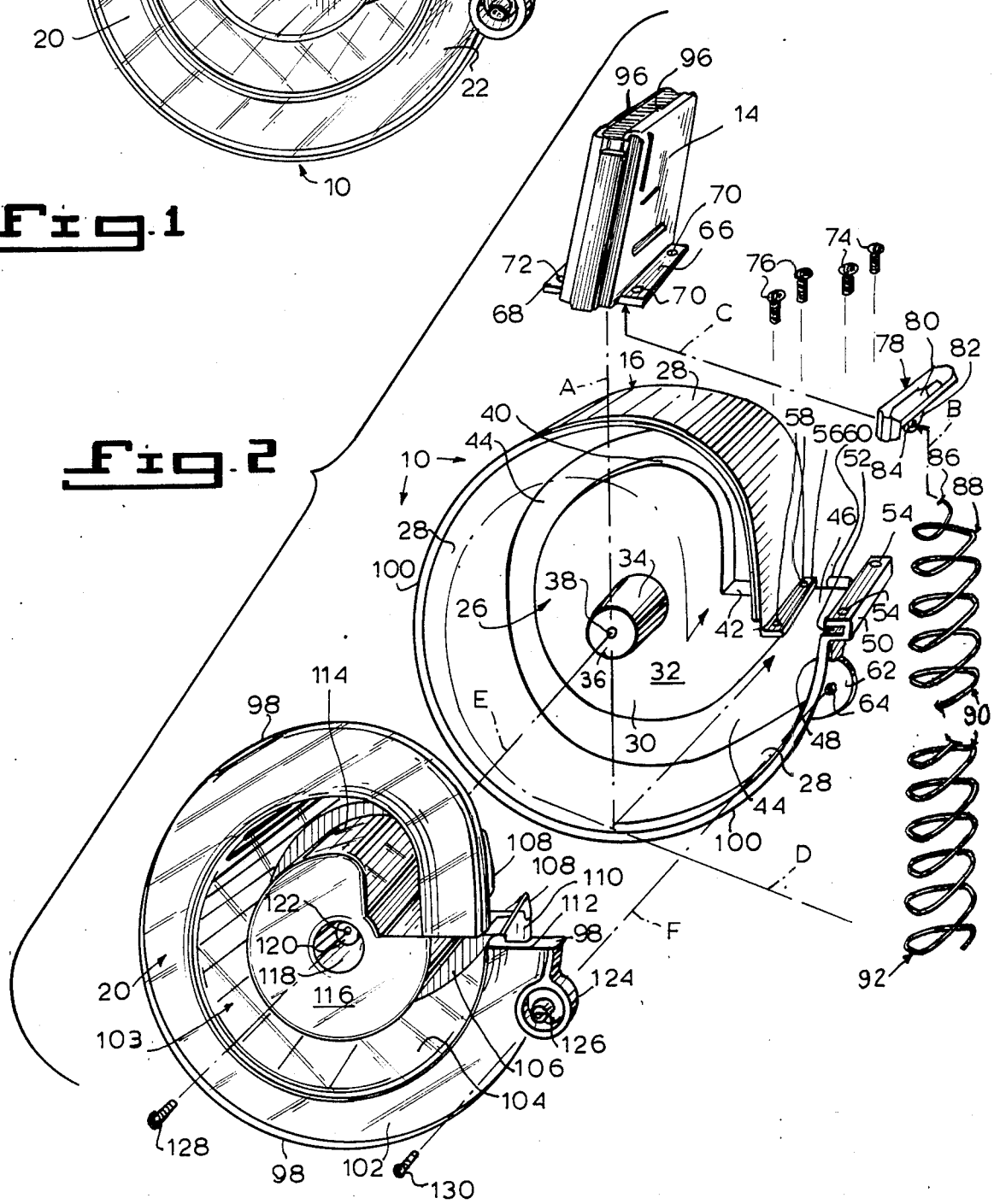
FIG. 2 is an exploded view of the small arm magazine illustrated in FIG. 1

FIG. 2 is an exploded view of the small arm magazine 10 that illustrates the construction of the interior of the magazine 10 and how the magazine is assembled. As illustrated in FIG. 2, the magazine drum 16 has a forward closed portion or wall 26 that closes off the forward end of the drum 16. The wall or forward portion 26 is connected to and forms an integral part of the adjacently located side wall 28 of the drum 16. The center portion of the forward portion 26 has a large central portion 30 that projects inwardly or toward the rear of the magazine drum 16. This portion 30 has a substantially flat inner or rearward surface 32 from which a centrally located generally cylindrical portion 34 projects toward the rear of the drum 16. The aft end 36 of the cylindrical portion 34 has a centrally located threaded aperture 38.

The outer peripheral portions of the large central portion 30 are connected to an integral outwardly or forwardly extending wall 40. This wall 40 is generally curved to form an outward extending spiral except that it has a generally flat portion 42 at its inner end. This wall 40, the adjacently located portion of the forward portion 26 and the inner surface 44 of the adjacent wall 28 form an outward spiraling trough or channel designated by the number 44. This trough or channel 44 surrounds and serves to help guide the forward portion of cartridges located within the housing portion 12 of the small arm magazine in a manner that will be hereinafter described in detail. The outer portion 46 of this trough or channel terminates at a generally rectangular slot 48 located in the wall 28 of the drum 16.

As best illustrated in FIG. 2, a clip member 50 is located along the outer edge of the slot 48 and this clip member has a centrally located slot 52 that faces inwardly and two apertures 54 that pass through the clip member 50 and into the slot 52. A substantially flat portion 56 is integrally connected to the wall 28 and is located immediately adjacent the slot 48 substantially directly across the slot 48 from the clip member 50. This flat portion has two apertures 58 extending through it. An upward projecting tab 60 is located immediately adjacent the forward opening of the slot 48 and is formed as an integral part of the drum 16. This tab 60 serves as a stop for the feed chute portion 14 as will be hereinafter described in detail. A partially circular flat tab 62 also extends outward from the rear outside circumference of the drum 16 in the vicinity of the slot 48 and this tab 62 has a threaded aperture 64 for use in connecting the drum cover 20 to the drum 16 as will be hereinafter described.

As illustrated in FIG. 2, the feed chute portion 14 is generally rectangular shaped with a hollow interior whose external shape corresponds substantially to the shape of the upper portion of a box magazine for the M-16 rifle or the like. Of course, the weapon or weapons for which the particular magazine 10 is designed will dictate the particular exterior shape for the feed chute portion 14. It is important to note that two substantially rectangular shaped mounting tabs 66 and 68 extend outward from the lower sides of the feed chute 14. The mounting tab 66 is sized and shaped to slide into slot 52 in the clip member 50. The tab 66 has two apertures 70 that are located to be aligned with the apertures 54 in the clip member 50 when the mounting tab 66 is in place. The tab 68 also has two apertures 72 (only one of which is shown in FIG. 2) that are aligned with the apertures 58 in the flat portion 56 when the tab 68 is in place.

As illustrated after the tab 66 of the feed chute 14 is inserted into the slot 52 of the clip member 50 with the forward lower portion of the feed chute portion 14 located against the tab 60, when the feed chute portion is moved as indicated by the dashed line A, the respective apertures 70 and 72 in the tabs 66 and 68 are aligned with the apertures 54 and 58 in the clip member 50 and the flat portion 56. After the respective apertures 54 and 70 and 58 and 72 are aligned respective self tapping screws 74 and 76 are inserted into and secured in a conventional manner in these respective apertures.

As best illustrated in FIG. 2, the magazine 10 has a follower 78 that has a raised portion 80 located on its upper right rear surface and a downward slender projection 82 on its lower surface. The projection 82 has an aperture 84 that is sized to receive the projecting portion 86 of the outer end portion 88 of the magazine coil compression spring 90 that also has an inner end portion 92. In the assembled small arm magazine 10, the projection 86 is located in the aperture 84 as indicated by the dashed line B and the follower 78 and the connected outer end portion 88 of the magazine spring 90 fits into the interior of the feed chute portion 14 as indicated by the dashed line C to bias the follower 78 in an upward and outward manner in order that the uppermost cartridge, such as the cartridge 94 illustrated in FIG. 1, is pushed against one of the magazine lips 96. In the assembled magazine 10, the portion of the magazine spring 90 that is not located within the chute portion 14 is curved and fits in the channel 44 in the magazine drum 16 so that the end of its inner end portion 92 rests against the flat wall portion 42 of the drum 16 as indicated by the dashed line D.

The details of the magazine cover 20 are illustrated in FIG. 2. Substantially, the entire outer circumference of the cover 20 has a lip portion 98 that is sized and shaped to slip over and fit around the corresponding rim portion 100 that is located around the outer rear circumference of the wall 28 of the drum 16. A cartridge guide cover portion 102 is located immediately adjacent the lip portion 98 of the cover 20. The cartridge cover portion 102 is curved in substantially the same manner as the oppositely located trough or channel 44. A generally circular shaped depression 103 is located immediately adjacent the cartridge cover portion 102 of the cover 20. This depression 103 is partially formed by a forward sloping curved wall portion 104 that is spaced from but is generally parallel to the wall 28 of the drum 16 when the cover 20 is in place on the drum 16. At the bottom of the depression 103 is a circular flat portion 106 that is located and shaped to fit up against the inner surface 32 of the drum 16 when the cover 20 is located in place when the magazine 10 is assembled.

A flange 108 extends forward toward the forward portion of the trough of the drum 16 from substantially the junction of the circular flat portion 106 and the curved wall portion 104 of the cover 20. The interior or inner surface portion of this flange 108 is sized and shaped to form a tight fit around the generally spiraling wall 40 of the drum 16 when the magazine 10 is assembled. When the flange 108 fits around or over the wall 40 with the magazine 10 assembled, the flange 108 and the adjacently located inner surface 110 of the forward sloping curved wall portion 104 contact, confine and serve to guide the inner portions of the follower 78, cartridges (not shown) that are being pushed by the follower 78, and the magazine compression spring 90. In a similar manner when the magazine 10 is assembled, the wall 28 of the drum 16 contacts, confines, and guides the outer portions of the follower 78, cartridges (not shown) and the magazine spring 90 and the surface of the trough 44 and the inner surface 112 of the cartridge guide cover 102 serve to guide respectively the forward and rearward portions of the follower 78 cartridges (not shown) and the single magazine spring 90. In view of this arrangement, the wall 28 and the trough 44 of the drum and the flange 108, the wall portion 104 with its inner surface 110 and the cartridge cover portion 102 with its inner surface 112 of the cover 20 comprise the cartridge guiding portion 22 of the housing portion 12 of the magazine 10.

As illustrated in FIG. 2, a curved rearward projecting wall 114 projects rearwardly from the inner edge of the flat portion 106 and this wall 114 is connected to a generally circular flat surface portion 116 that has a generally cylindrical depression 118 in its center portion. The bottom portion 120 of this depression 118 has a centrally located aperture 122 that is located to be substantially aligned with the aperture 38 of the cylindrical portion of the drum 16 when the magazine 10 is assembled. The general purpose of the wall 114, flat surface 116, and the depression 118 is to give the cover 20 strength and rigidity.

It will be noted that a generally circular thin tab portion 124 is located on the outer circumference of the cover 20 adjacent its rim portion 98. This tab portion 124 has an aperture 126 that is located to be aligned with the aperture 64 of the tab 62 of the drum 16 when the magazine 10 is assembled. To assemble the cover 20 to the drum 16, a suitable bolt or screw 128 is inserted through the aperture 122 and threaded into the aperture 38 in the drum 16 as indicated by the dashed line E and another screw 130 which may be self tapping is inserted through the aperture 126 and threaded into the aperture 64 in the drum 16 as indicated by the dashed line F. When these screws 128 and 130 are tightened in place the cover 20 is tightly secured to the drum 16 and since the screw 130 is located on the outer circumference of the cover 20 this gives the cover and the drum the ability to resist twisting or torque forces that would tend to twist or dislocate them.

Figure 3:
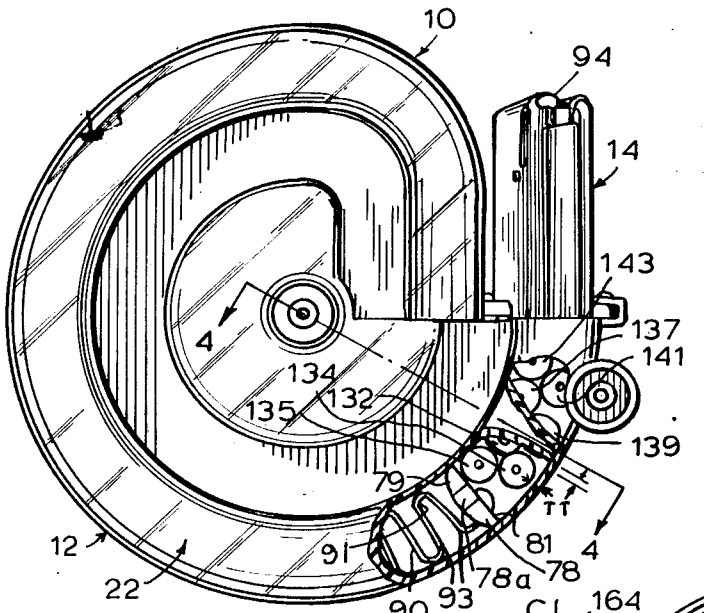
FIG. 3 is a rear elevational view of the small arm magazine illustrated in FIGS. 1 and 2 with certain parts thereof broken away.

FIG. 3 illustrates the rear of the small arm magazine 10 with portions of its cover 20 broken away to illustrate the interior of the cartridge feeding portion 22. As illustrated, the magazine spring 90 that is located within the cartridge guiding portion 22 pushes outwardly against and hence biases the follower 78 in an outward direction within the cartridge portion 22. The follower 78 in turn exerts an outward force against the cartridges located within the cartridge guiding portion 22 such as those illustrated and designated by the numbers 132, 134, 135, 137, 139, 141, 143, and 94.

It is important to note that the inner portion of the spring 90 in the feeding portion 22 represented by the number 91 has its coil portions closer together and is hence under greater pressure than the outer portion of the spring represented by the number 93 which has its coil portions further apart. Consequently, the inner part 91 of the spring 90 exerts a greater force on the adjacently located inner portion 79 of the follower 78 than its outer portion 81 and this results in greater pressure being exerted upon the inner cartridges such as the cartridges 132, 137 and 141 in the feeding portion 22 than the cartridges 134, 135, 139 and 141 in the outer column in the feeding portion 22. As a consequence, the inner cartridges such as those designated 132, 137, and 141 are tightly packed together whereas the outer cartridges 134, 135, 139 and 141 are loosely packed and have the tolerances or gaps represented by the letter T between themselves and also the outer wall 28 of the feed portion 22. The projection 80 on the upper outer surface of the follower 78 also assists in maintaining this relationship since it exerts an innerward force against the inner column of cartridges that includes those designated 132, 137 and 141.

Figure 4:
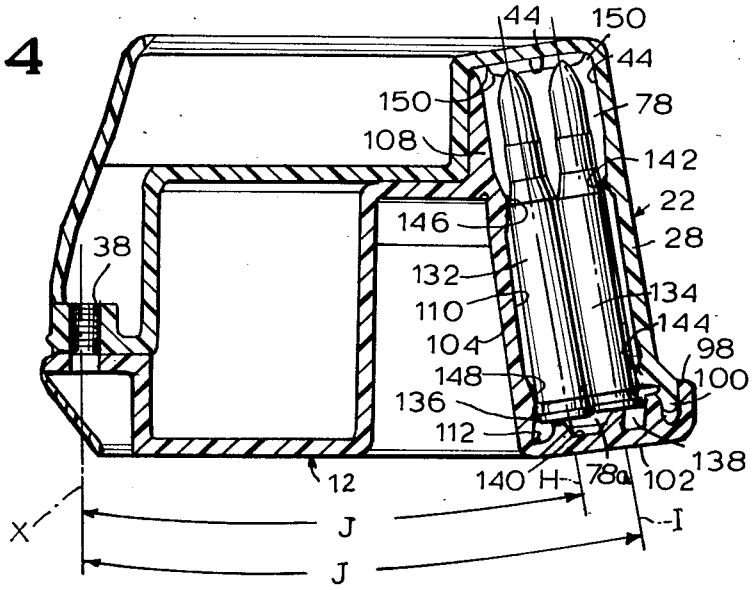
FIG. 4 is an enlarged sectional view of a portion of the structure illustrated in FIG. 3 taken substantially on the line 4—4 thereof.

FIGS. 3 and 4 illustrate further details of the housing portion 12 of the magazine 10 including the cartridge guiding portion 22. As illustrated, the cartridge guiding portion 22 includes the wall 28, the trough 44, the flange 108, the wall portion 104 with its inner surface 110 and the cartridge cover portion 102 with its inner surface 112 and as indicated these members and portions contact, confine and guide the magazine follower 78 and the associated cartridges such as the cartridges 132 and 134. It should be noted that the inner surface 110 of the cover portion 102 has two projecting ribs 136 and 138 that contact the rear portions of the respective cartridges 132 and 134 and also create a groove 140 that serves to guide the rear portion 78*a* of the follower 78.

The inner surface of the wall 28 has two raised portions 142 and 144 that contact and guide the follower 78 and the side of the cartridge 134 and in a similar manner the inner wall 104 has similar raised portions 146 and 148 that also contact and guide the follower 78 and the side of the cartridge 132. These raised portions 136, 138, 142, 144, 146 and 148 extend throughout the cartridge guiding portion 22 and since they reduce the contact with the cartridges and hence the friction of the cartridge guiding portion they serve as means for reducing friction as the cartridges are guided through the cartridge guiding means 22.

As illustrated in FIG. 4, the follower 78 has two substantially identical small rounded projections 150 extending forward from the follower's upper forward surface. These projections 150 contact the adjacent surface of the trough 44 of the cartridge guiding portion 22 of the housing portion 12 of the magazine 10 and since these projections 150 limit the contact between the forward portion of the follower 78 and the adjacent portion of the trough or channel 44 they reduce friction between the forward portion of the follower 78 and the channel 44. This reduction in friction reduces jamming associated with the follower 78 in the cartridge guiding portion 22 and hence the projections 150 comprise means located on the follower 78 for reducing jamming of the follower in the cartridge guiding portion 22.

Also as best indicated in FIG. 4, the cartridges in the cartridge guiding portion 22 such as the cartridges designated by the numbers 132 and 134 are canted or pointed inwardly with their forward or bullet portions pointing toward the central portion of the housing portion 12 whose center line is designated by the letter X. The center line of the cartridges 132 and 134 are designated by the respective letters H and I and these center lines intersect the center line X at an angle designated by the letter J. In the preferred embodiment this angle J is between about three degrees and about thirteen degrees and preferably about eight degrees. This configuration of the cartridge guiding portion 22 that results in the cartridges such as the cartridges 132 and 134 being canted or pointing inwardly has proven to be necessary in order to have proper feeding of the cartridges such as the cartridges 132 and 134 through the cartridge guiding portion 22.

Figure 5:
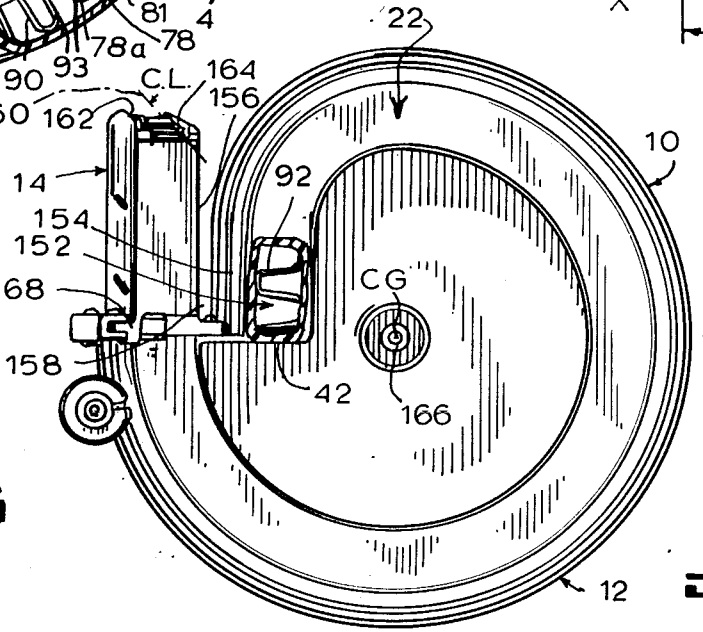
FIG. 5 is a front elevational view of the small arm magazine illustrated in FIGS. 1 through 3.

As illustrated in FIG. 5 the inner portion 152 of the cartridge guiding portion 22 that is located adjacent the feed chute portion 14 is substantially straight rather than curved and consequently its exterior wall 154 is located substantially parallel to the adjacent exterior wall 156 of the feed chute portion 14. There is also a gap or space 158 between the adjacently located walls 154 and 156. This space or gap 158 allows the magazine feed chute portion 14 to be inserted into the magazine well (not shown) of a small arm without having the inner portion 152 and its wall 154 interfere with the small arm or interfere with the proper insertion of the feed chute portion 14. It should be noted that the inner portion 152 is only designed to accept the inner end portion 92 of the spring 90 and not any cartridges and consequently, there is no possible problem of having cartridges jam in the straight inner portion 152.

As also illustrated in FIG. 5, the wall portion 42 serves as a rest or seat within the drum 16 for the inner end 92 of the spring 90. This seat or wall portion 42 is important since it forms part of the drum 16 and permits the drum cover 20 to be removed for cleaning or inspection purposes, etc. without disturbing the inner end 92 so it becomes loose or free. This wall portion 42 for the same reasons assists in the assembly of the magazine 10 because the inner end 92 can be pushed into place with its outer end resting on wall portion 42 so that the cover 20 can be placed on the drum 16 without any interference from a loose spring end 92. The wall portion 42 also assists in disassembly of the magazine since the cover 20 can be easily removed without interference from a loose spring end 92.

Figure 6:
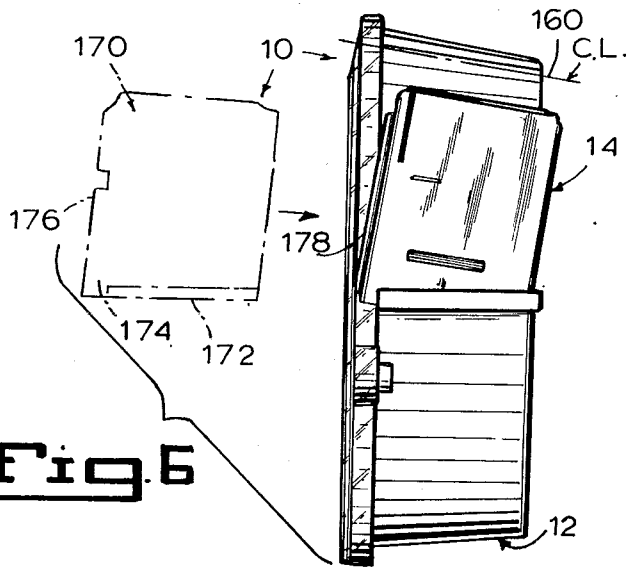
FIG. 6 is a right side elevational view of the small arm magazine illustrated in FIGS. 1 through 3 and 4.

In FIGS. 5 and 6 the relationship of the small arm magazine 10 and the centerline of the bore of the firearm barrel (not shown) when the magazine in its normal in use orientation is loaded in the small arm is illustrated and the location of the adjacent portion of the centerline of the bore is designated by the number 160 and the abbreviation C. L. As illustrated the bore centerline 160 is substantially parallel to the upper edges 162 and 164 of the sides of the feed chute portion 14 of the magazine 10. The center of gravity of the magazine 10 when it is fully loaded with cartridges is abbreviated with the letters C. G. and designated with the number 166 and as it can be seen this center of gravity 166 is located substantially below the adjacent portion of the bore centerline 160 when the magazine 10 is viewed from its front as illustrated in FIG. 5. This location of the center of gravity 166 of the magazine 10 provides means for reducing climbing of the associated small arm (not shown) when the small arm is fired and the magazine is substantially loaded with cartridges and located in the small arm. This is true because the weight distribution due to the center line 166 counters the recoil force exerted on the small arm when it is fired.

As also illustrated in FIGS. 5 and 6, a substantial portion or substantially half of the drum shaped housing portion 12 is located above the lower end portion 168 of the cartridge feed chute portion 14. Since a substantial portion of the feed chute portion 14 is located within the magazine well of a small arm (not shown) when the magazine 10 is inserted into the small arm and is ready for use this location of a substantial portion of the drum shaped housing portion 12 above the lower end portion 168 of the feed chute portion 14 results in a significant decrease in the amount of the magazine 10 that extends below a small arm when the magazine is in place in the small arm and ready for use and hence constitutes means for reducing the interference of the magazine 10 with the use of the associated small arm (not shown) in which it is loaded or inserted. In this connection even though the number of cartridges that can be loaded into the magazine 10 may be quite large, the portion of the magazine that extends below the associated small arm (not shown) is not large and will not interfere with the use of the small arm such as by interfering with the use and loading of the small arm when the user is in the prone or similar position.

FIG. 6 illustrates a unique feature of the small arm magazine 10. As illustrated in FIG. 6 a substitute different cartridge feed chute portion designated by the number 170 and illustrated in phantom lines can be substituted for the previously discussed feed chute portion 14. This substitution is made possible by the unique construction of the magazine 10 as previously discussed in detail particularly in connection with FIG. 2. In this connection, the feed chute portion 14 is easily removable from the remainder of the small arm magazine 10 by simply removing the previously mentioned screws of fasteners 74 and 76 after the removal of other components of the small arm magazine 10 in the manner previously described with respect to FIG. 2. The substitute cartridge feed chute 170 has its lip portion 172 inserted into the slot 52 in the clip member 50 and then appropriately secured in place with the fasteners 74 and 76 in a conventional manner. The remainder of the magazine 10 is then assembled in the previously described manner. Of course, the lower portion 174 including the lip portion 172 must be configured to be compatible with the appropriate portions of the rest of the magazine 10 to which it is connected including the clip member 50.

As illustrated in FIG. 6 the substitute cartridge feed chute portion 170 has a different external configuration such as the rear portion designated 176 than the external configuration of the feed chute 14 with its rear portion 178. The rear portions 176 and 178 are different and they are sized and shaped to permit the respective cartridge feed chutes 170 and 14 to be used in the different sized and shaped magazine wells (not shown) of two different small arms. This ability to interchange or change cartridge feed chutes 14 and 170 permits the other portions of the magazine 10 to be used with two or more different small arms with different sized and shaped magazine wells and hence comprises means for permitting the small arms magazine 10 to be used with at least two different small arms having different sized and shaped magazine wells that are not sized and shaped to accept an interchangeable magazine. It will of course be appreciated that even though portions of the exterior of the feed chute portion 170 are different from the feed chute portion 14 their interiors must be substantially identical.

The small arm magazine 10 is made and used in the following manner. All of the components of the magazine 10 except the magazine spring 90 and the fasteners are made from a suitable thermoplastic. In the preferred embodiment of the small arm magazine 10, the cartridge feed chute portion 14 and the follower 78 will be made from a harder and more wear resistant plastic and from a plastic having a lesser degree of thermoexpansion than the rest of the plastic parts of the small arm magazine 10. The unique construction of the magazine 10 permits the use of and comprises means for permitting the use of two or more types of plastics in the feed chute portion 14 and the drum shaped housing portion 12.

This unique construction also permits two different types of plastics in connection with the drum shaped housing portion 12 since one type of plastic such as a clear plastic can be used for the drum cover 20 and a different type of plastic such as an opaque dark plastic can be used for the drum 16. With such a clear plastic construction the number of remaining cartridges can be clearly seen through the clear plastic of the drum cover 20 but undesirable reflections are reduced or eliminated with the dark plastic drum 16 since light is absorbed by the dark plastic and this reduces or eliminates light that not only could be reflected directly from the plastic drum 16 but also from the drum through the cover 20.

The various plastic parts of the magazine 10 are molded using standard thermoplastic molding techniques that are known in the art. In the preferred embodiment, the thermoplastic molding would be accomplished using runnerless molding techniques since this results in parts that are substantially ready for use without having to have runners removed, etc.. However, some holes may have to be drilled and possibly tapped in a manner known in the art. The other non-plastic parts of the magazine such as the spring 90 and the fasteners 128, 130, 74 and 76 are made form suitable steel in a manner known to those skilled in the art.

After the various parts of the magazine 10 have been made the magazine 10 is assembled in the manner indicated in FIG. 2. First, the cartridge feed chute portion 14 is connected to the drum 16 by pushing its tab portion 66 all of the way into the slot 52 in the clip member 50 as indicated by the line A and then inserting and screwing the screws 74 into the holes 54 and 70 and the screws 76 in the holes 72 and 58. Then, the projection 86 of the spring 90 is inserted into the hole 84 in the follower 78 as indicated by the line B if this has not already been accomplished. Next, the follower 78, with its forward portion pointing toward the forward portion of the feed chute 14, and the connected outer end portion 88 of the spring 90 are inserted into the hollow lower interior portion of the cartridge feed chute portion 14 as indicated by the line C. Then, the spring 90 is compressed and curved or bent to generally conform to the inner forward portion of the drum 16 and the end of the spring's inner end portion 92 is placed upon the flat portion 42 that serves as the spring retaining means as illustrated by the line D. After this has been accomplished the spring 90 is secured in place within the drum 16 and the cartridge feed chute portion 14.

The next step in the assembly of the magazine 10 is to located the drum cover 20 in position to the rear of the drum 16 as illustrated in FIG. 2. The drum cover 20 is then pushed into place over the open rear portion of the drum 16 so that the flange 108 of the cover 20 fits around the wall 40 of the drum 16 as illustrated in FIGS. 2 and 4. The respective screws 128 and 130 are then inserted as indicated by the respective lines E and F and then tightened. The magazine 10 is then fully assembled.

Disassembly of the magazine 10 is easily accomplished by reversing the previously described procedure. Of course, if it is desired the substitute cartridge feed chute 170 can be used in place of the cartridge feed chute 14 to enable the magazine to be used in a different small arm. The assembled magazine 10 is loaded with cartridges and used in a conventional manner. In this connection, cartridges can be inserted into the top of the feed chute portion 14 or 170 one by one by hand or they can be inserted through the use of stripper clips (not shown). Once the magazine is loaded with cartridges, its feed chute portion 14 or 170 is inserted in the magazine well (not shown) of the small arm in a conventional manner. After all of the cartridges in the magazine 10 have been fired, the feed chute portion 14 or 170 of the magazine 10 is then released from the magazine well (not shown) of the small arm by pushing a magazine release button or the like (not shown) in a conventional manner. The released magazine can then be reloaded in a conventional manner and reused.

Although the invention has been described in considerable detail with reference to a certain preferred embodiment, it will be understood that variations or modifications can be made to the invention without departing from the spirit and scope of the invention as defined in the appended claims.

What is claimed is:

1. A small arm magazine for a small arm having a magazine well or the like comprising a generally drum shaped housing portion including cartridge guiding means located therein for guiding at least one column of cartridges in at least a partially curved manner, said cartridge guiding means having a substantially straight portion and having means for reducing friction with cartridges located in said cartridge guiding means, and projecting cartridge feeding means projecting outwardly from said generally drum shaped housing portion in a direction generally tangential to the outer portion of said generally drum shaped housing portion for fitting into and feeding cartridges into the magazine well of said small arm, said projecting cartridge feeding means having an outer upper end portion and a lower inner end portion with said lower inner end portion being located with respect to said generally drum shaped portion whereby a substantial portion of said generally drum qhaped housing portion is located at a level above the level of the lower inner end portion of said projecting cartridge feeding means when said small arm magazine is oriented for normal use.

2. The small arm magazine of claim 1 wherein said cartridge guiding means comprises means for guiding at least two columns of cartridges.

3. The smal arm magazine of claim 2 wherein said cartridge guiding means comprises an outwardly spiraling channel.

4. The small arm magazine of claim 2 comprising means for reducing or eliminating jamming of cartridges in said cartridge guiding means.

5. The small arm magazine of claim 4 wherein said means for reducing or eliminating jamming of cartridges in said cartridge guiding means comprises means for exerting different pressure on cartridges at different positions in said cartridge guiding means.

6. The small arm magazine of claim 5 wherein said two columns of cartridges comprise an inner column located toward the center portion of said small arm magazine and an outer column located outward from said inner column and wherein said means for exerting different pressure on cartridges at different positions comprises means for exerting a greater pressure on the cartridges in the inner column of cartridges than on the cartridges in the outer column of cartridges.

7. The small arm magazine of claim 5 further comprising means for permitting said small arm magazine to be used with small arms having at least two different sized and shaped magazine wells.

8. The small arm magazine of claim 7 wherein said means for permitting said small arm magazine to be used with small arms having at least two different sized and shaped magazine wells comprises said projecting cartridge feeding means being removable from said generally drum shaped housing portion and substitute projecting cartridge feeding means having a different external configuration to fit in a different magazine well but being sized and shaped to fit on said generally drum shaped housing portion.

9. The small arm magazine of claim 2 wherein cartridges located in said cartridge guiding means are located by said cartridge guiding means in such a manner that the long axes of said cartridges form an angle with the centerline of said generally drum shaped housing portion.

10. The small arm magazine of claim 9 wherein the angle formed by the long axes of said cartridges with the centerline of said generally drum shaped housing portion is between about three degrees and about thirteen degrees.

11. The small arm magazine of claim 1 wherein said means for reducing friction with cartridges located in said cartridge guiding means comprises raised portions located in said cartridge guiding means for contacting said cartridges.

12. The small arm magazine of claim 1 further comprising a cartridge follower located within said cartridge guiding means and wherein said follower has means for reducing jamming of said follower within said cartridge guiding means.

13. The small arm magazine of claim 12 wherein said jamming reducing means comprises porjections extending from said follower for contacting said cartridge guiding means.

14. The small arm magazine of claim 1 wherein said projecting cartridge feeding means has an exterior wall located adjacent said generally drum shaped housing portion and a gap exists between said exterior wall and the adjacent portion of said generally drum shaped portion.

15. The small arm magazine of claim 1 further comprising means located in said generally drum shaped portion for assisting in assembly and disassembly of said small arm magazine.

16. The small arm magazine of claim 15 wherein said assembly and disassembly assisting means comprises means for maintaining at least one movable magazine part in position during assembly and disassembly.

17. The small arm magazine of claim 1 wherein said generally drum shaped housing comprises a plastic material and wherein said projecting cartridge feeding means comprises a plastic material of a different type than the plastic material of said generally drum shaped housing portion.

* * * * *